US011850849B2

(12) United States Patent
Duan et al.

(10) Patent No.: US 11,850,849 B2
(45) Date of Patent: Dec. 26, 2023

(54) ARRAYED ELECTROHYDRODYNAMIC PRINTHEAD WITHOUT EXTRACTION ELECTRODES

(71) Applicant: HUAZHONG UNIVERSITY OF SCIENCE AND TECHNOLOGY, Hubei (CN)

(72) Inventors: Yongqing Duan, Hubei (CN); Weili Yang, Hubei (CN); Huayang Li, Hubei (CN); Jixin Gao, Hubei (CN); Zhouping Yin, Hubei (CN)

(73) Assignee: HUAZHONG UNIVERSITY OF SCIENCE AND TECHNOLOGY, Hubei (CN)

( * ) Notice: Subject to any disclaimer, the term of this patent is extended or adjusted under 35 U.S.C. 154(b) by 0 days.

(21) Appl. No.: 18/016,356

(22) PCT Filed: Sep. 15, 2022

(86) PCT No.: PCT/CN2022/118888
§ 371 (c)(1),
(2) Date: Jan. 16, 2023

(87) PCT Pub. No.: WO2023/040924
PCT Pub. Date: Mar. 23, 2023

(65) Prior Publication Data

US 2023/0339227 A1 Oct. 26, 2023

(30) Foreign Application Priority Data

Sep. 15, 2021 (CN) ..... 202111078207.7

(51) Int. Cl.
*B41J 2/045* (2006.01)
*B41J 2/06* (2006.01)

(52) U.S. Cl.
CPC ..... *B41J 2/06* (2013.01); *B41J 2/04576* (2013.01); *B41J 2002/062* (2013.01); *B41J 2202/18* (2013.01)

(58) Field of Classification Search
CPC . B41J 2/035; B41J 2/06; B41J 2/04576; B41J 2202/18; B41J 2002/061; B41J 2002/062
See application file for complete search history.

(56) References Cited

U.S. PATENT DOCUMENTS 7,404,626 B2 * 7/2008 Piatt ..... B41J 2/025 347/76
10,336,071 B2 * 7/2019 Poulikakos ..... B41J 2/1433
(Continued)

FOREIGN PATENT DOCUMENTS

CN 1684834 10/2005
CN 104191819 12/2014
(Continued)

OTHER PUBLICATIONS

"International Search Report (Form PCT/ISA/210) of PCT/CN2022/118888," dated Oct. 31, 2022, pp. 1-5.
(Continued)

*Primary Examiner* — Kristal Feggins
(74) *Attorney, Agent, or Firm* — JCIPRNET

(57) ABSTRACT

An arrayed electrohydrodynamic printhead without the extraction electrodes is provided. A printhead is formed by an ink cartridge, a flow channel plate, a nozzle plate, a control electrode layer. The ink cartridge includes an ink inlet, an ink outlet, an installation hole, a flow channel layer inlet, flow channel layer outlet. The flow channel plate has the functions of guiding the ink to flow into the nozzle plate and increasing the potential difference between the nozzles, and includes a flow channel inlet, a flow channel outlet, a drainage channel, and a microfluidic channel. A body of the nozzle plate includes nozzles and nozzle electrodes. The
(Continued)

microfluidic channel forms a voltage division unit between each nozzle, so that the voltage on the triggered nozzle is dispersed in the flow channel without affecting other nozzles, and independent and controllable injection of each nozzle is thereby achieved.

8 Claims, 5 Drawing Sheets

(56) References Cited

U.S. PATENT DOCUMENTS

| | | | | |
|---|---|---|---|---|
| 11,247,207 | B2 * | 2/2022 | Jokerst | H01L 31/035281 |
| 2005/0024433 | A1 * | 2/2005 | Cruz-Uribe | B41J 2/14201 347/50 |
| 2007/0101934 | A1 | 5/2007 | Nishio et al. | |
| 2007/0126799 | A1 | 6/2007 | Steiner | |

FOREIGN PATENT DOCUMENTS

| | | |
|---|---|---|
| CN | 105047520 | 11/2015 |
| CN | 111152559 | 5/2020 |
| CN | 111823570 | 10/2020 |
| CN | 112265379 | 1/2021 |
| CN | 112937122 | 6/2021 |
| CN | 113799491 | 12/2021 |
| IN | 1832858 | 9/2006 |

OTHER PUBLICATIONS

"Written Opinion of the International Searching Authority (Form PCT/ISA/237) of PCT/ CN2022/118888," dated Oct. 31, 2022, pp. 1-5.

* cited by examiner

ARRAYED ELECTROHYDRODYNAMIC PRINTHEAD WITHOUT EXTRACTION ELECTRODES

CROSS-REFERENCE TO RELATED APPLICATION

This application is a 371 of international application of PCT application serial no. PCT/CN2022/118888, filed on Sep. 15, 2022, which claims the priority benefit of China application no. 202111078207.7, filed on Sep. 15, 2021. The entirety of each of the above-mentioned patent applications is hereby incorporated by reference herein and made a part of this specification.

TECHNICAL FIELD

The disclosure belongs to the technical field of inkjet printing devices, and in particular, relates to an arrayed electrohydrodynamic printhead without extraction electrodes.

DESCRIPTION OF RELATED ART

As a maskless and additive manufacturing direct writing technology, inkjet printing exhibits high material utilization and therefore has good application prospects in many manufacturing fields, such as printed display, printed OTFT, printed solar cells, etc. At prese nt, piezoelectric inkjet printing and thermal inkjet bubble printing are the representing technologies in the conventional inkjet printing technologies. In piezoelectric/thermal bubble inkjet printing, extrusion force is used as the driving force, so that the inkjet printing process is very sensitive to the ink viscosity, and the extruded ink droplet is generally larger than the diameter of the nozzle, so that there are shortcomings such as low printing resolution (>20 μm) and narrow ink viscosity range (1-20 cP), which make it difficult to meet the printing needs of various materials and higher resolutions. In the electrohydrodynamic printing technology, the electric field is used as the main driving force. The "pulling" force generated by the electric field on the liquid greatly reduces the dependence of inkjet printing on the viscosity of the solution. Further, the size of the printed ink droplet can be much smaller than the diameter of the nozzle, and the resolution of the electrohydrodynamic printing may reach the sub-micron or even nano-meter scale, which greatly improves the resolution of the conventional inkjet printing. Therefore, the electrohydrodynamic printing technology has wide application prospects.

Electrohydrodynamic printhead is the key to achieve electrohydrodynamic printing. At present, the independent and controllable injection of the electrohydrodynamic printhead is achieved through the external electrode rings, but the jets are easily deflected to the external electrode rings and cause the nozzles to fail. At present, electrohydrodynamic printhead without external electrode rings can only meet the needs of parallel printing but cannot achieve independent controllability. It thus can be seen that requirements for electrohydrodynamic printing on demand in the industry is difficult to be satisfied.

Chinese patent application CN201410289239.5 provides a method for achieving independent controllable printing of nozzles. However, it is necessary to add extraction electrodes in front of the nozzles, and the ink may be easily deflected to the extraction electrodes, causing damage to the nozzles. Further, the structure is complicated and is difficult to be manufactured. Chinese patent application CN201510299992.7 provides a miniature electrospray chip device and a manufacturing method. However, its spray chip cannot independently regulate the printing state of each nozzle.

SUMMARY

In response to the above defects or requirements for improvement of the related art, the disclosure provides an arrayed electrohydrodynamic printhead without extraction electrodes. By making triggered nozzles, voltage division units, and non-triggered nozzles constitute a voltage division circuit, independent control of nozzles can be achieved through regulating the resistance value of the voltage division unit. This solves the technical problem that it is impossible to independently adjust the printing state of each nozzle.

To achieve the above, according to an aspect of the disclosure, the disclosure provides an arrayed electrohydrodynamic printhead without extraction electrodes including an ink cartridge, a flow channel plate, and a nozzle plate.

The flow channel plate is disposed at a bottom portion of the ink cartridge, and a flow channel cavity thereof includes a plurality of microfluidic channels communicating with the ink cartridge.

The nozzle plate is disposed at a bottom portion of the flow channel plate. The nozzle plate includes a plurality of nozzles and nozzle electrodes assembled therewith. The plurality of nozzles are correspondingly disposed and communicating with the plurality of microfluidic channels. Ink flows from the ink cartridge through the flow channel cavity and is ejected from the nozzles.

The microfluidic channels between different nozzles and the ink in the microfluidic channels form a plurality of voltage division units. The triggered nozzles, the voltage division units, and the non-triggered nozzles form a voltage division circuit when a voltage is applied to the nozzles. By adjusting the resistance value of the voltage division units or the grounding resistance value of the non-triggered nozzles, a potential difference between the triggered nozzles and the non-triggered nozzles is changed, so that a difference between the applied voltage and the potential difference is less than a onset threshold voltage, and that the nozzles are independently controlled.

Preferably, the flow channel cavity further includes a flow channel inlet, a flow channel outlet, and a drainage channel. The flow channel inlet and the flow channel outlet are located at both ends of the flow channel cavity. The drainage channel is disposed between the flow channel inlet and the plurality of microfluidic channels and between the flow channel outlet and the plurality of microfluidic channels and is configured to drain the ink in the ink cartridge into the microfluidic channels or to drain the ink in the microfluidic channels into the ink cartridge.

Preferably, the plurality of microfluidic channels include a tree-like bifurcated structure distribution, a bifurcated structure distribution, and a strip-shaped structure distribution.

Preferably, the ink cartridge comprises a cartridge body and installation holes, slots, an ink inlet, an ink outlet, a flow channel layer inlet, and a flow channel layer outlet disposed in the cartridge body. The slots are located on both sides of the cartridge body, the installation holes are disposed on the slots. The ink inlet and the ink outlet are disposed on an upper end of the cartridge body. The flow channel layer inlet is disposed on a lower end of the cartridge body and communicates with the flow channel inlet. The flow channel layer outlet is disposed on the lower end of the cartridge body and communicates with the flow channel outlet.

Preferably, the adjustment of the resistance of the voltage division units is implemented by adjusting the electrical resistivity of the ink and/or a geometric dimension of the microfluidic channels.

Preferably, each of the nozzles are made of an insulating material. One end of each of the nozzles is a hollow boss structure, and the hollow boss structures correspond to through holes of the microfluidic channels one-to-one.

Preferably, the nozzle plate further includes a hydrophobic layer. The hydrophobic layer is disposed on an outer surface of the nozzles and the nozzle electrodes.

Preferably, the ink cartridge is made of an insulating material or a conductive material plus a layer of insulating material.

To sum up, when the above technical solutions provided by the disclosure are compared with the related art, since the connection structure between different nozzles is composed of the flow channel cavity, ink, etc. to form the voltage division unit, the voltage interference between the nozzles is suppressed. When a voltage is applied to a nozzle and injection is started, a voltage division unit that is triggered nozzle-voltage division unit-non-triggered nozzle is formed in the printhead. After passing through the voltage division unit, when the voltage distributed on the non-triggered nozzle drops below the onset voltage, independent controllable injection can be achieved. The control electrode can individually adjust the magnitude of the electric field at each nozzle, thereby controlling the power-on state of each nozzle. It solves the problem that it is difficult for electrohydrodynamic printing nozzles to achieve independent and controllable printing, and other problems such as low efficiency and crosstalk between nozzles are solved as well. Advantages such as high resolution, high precision, high efficiency, batch manufacturing, and low costs are provided.

DESCRIPTION OF THE EMBODIMENTS

In order to make the objectives, technical solutions, and advantages of the disclosure clearer and more comprehensible, the disclosure is further described in detail with reference to the drawings and embodiments. It should be understood that the specific embodiments described herein serve to explain the disclosure merely and are not used to limit the disclosure. In addition, the technical features involved in the various embodiments of the disclosure described below can be combined with each other as long as the technical features do not conflict with each other.

Figure 1:
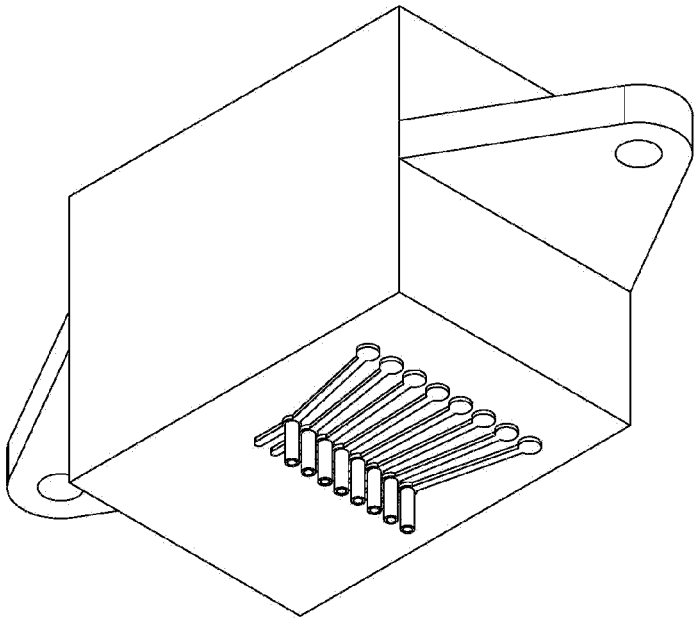
FIG. 1 is a three-dimensional view of an arrayed electrohydrodynamic printhead without extraction electrodes provided by the disclosure.
Figure 2:
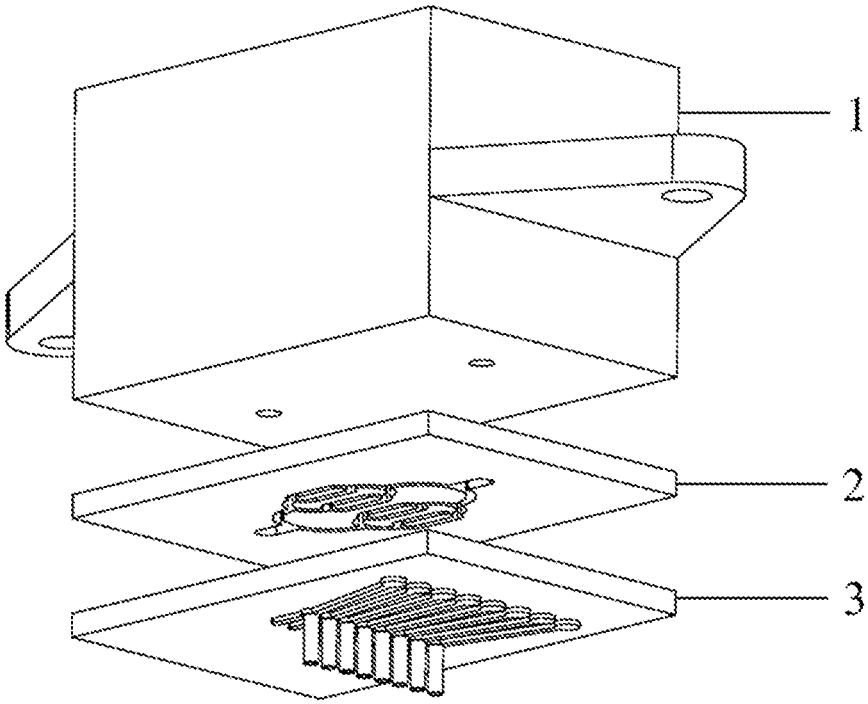
FIG. 2 is a structural exploded view of the arrayed electrohydrodynamic printhead without extraction electrodes provided by the disclosure.
Figure 3:
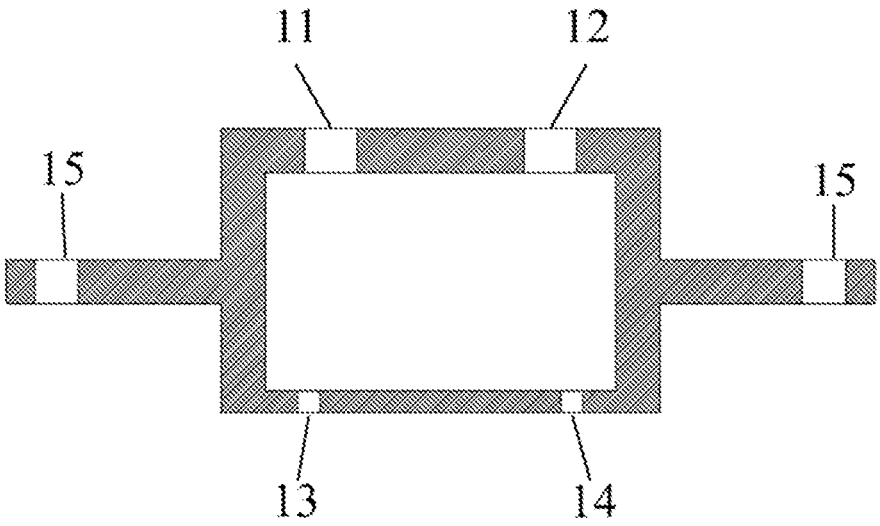
FIG. 3 is a cross-sectional view of an ink cartridge of the arrayed electrohydrodynamic printhead without extraction electrodes provided by the disclosure.
Figure 4:
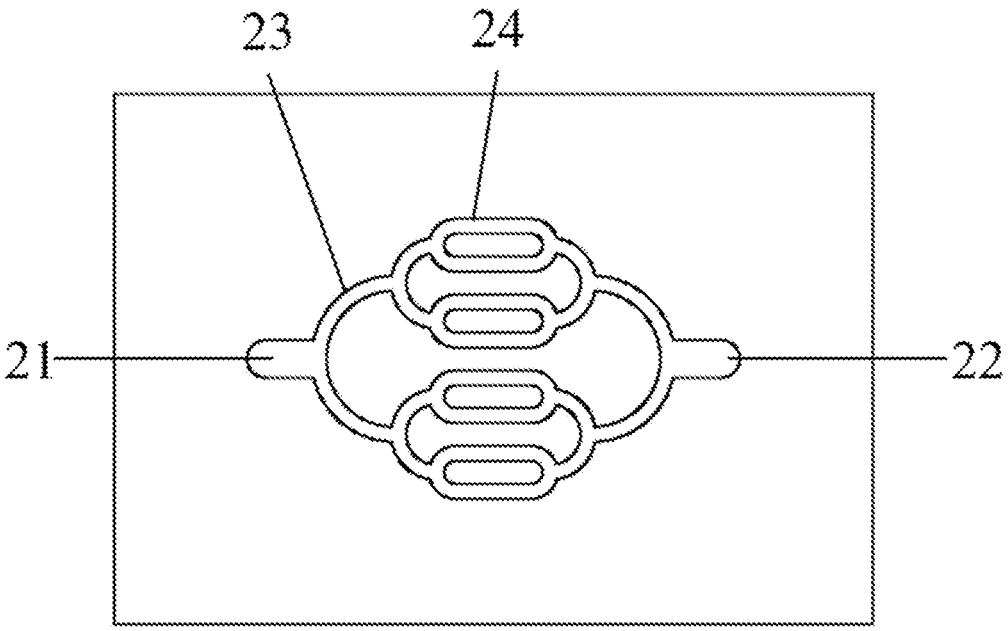
FIG. 4 is a schematic structural view of a flow channel plate of the arrayed electrohydrodynamic printhead without extraction electrodes provided by the disclosure.
Figure 5:
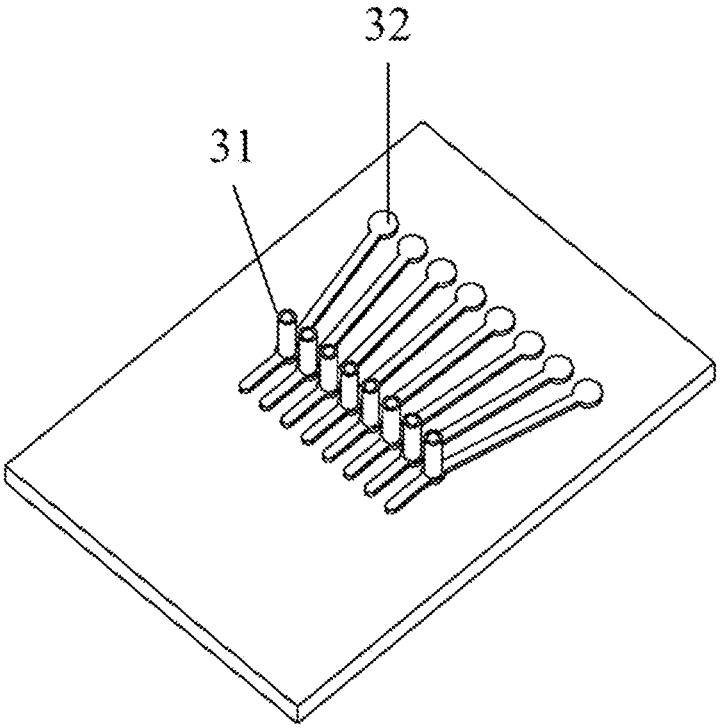
FIG. 5 is a schematic structural view of a nozzle plate of the arrayed electrohydrodynamic printhead without extraction electrodes provided by the disclosure.
Figure 6:
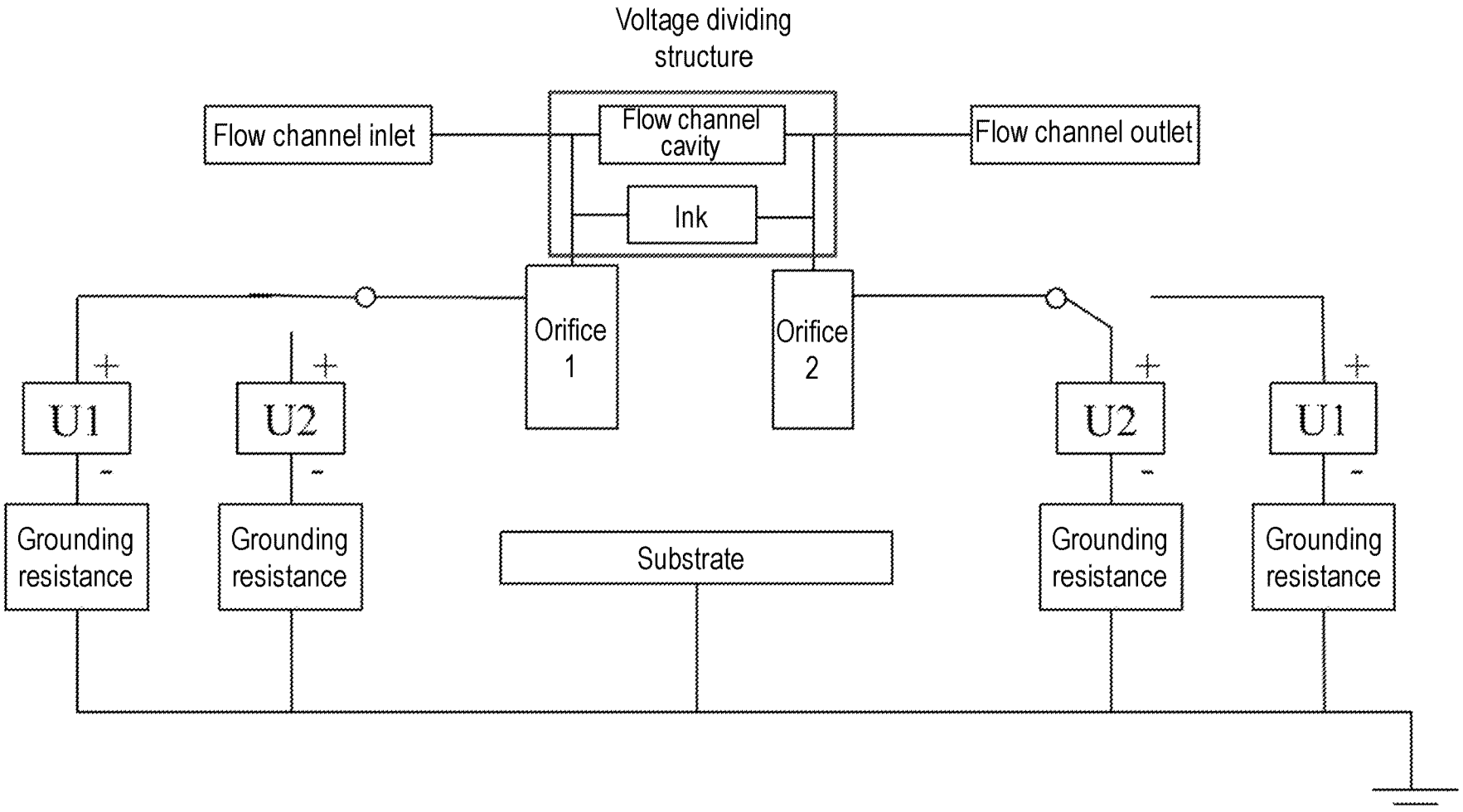
FIG. 6 is a schematic diagram of the arrayed electrohydrodynamic printhead without extraction electrodes provided by the disclosure.
Figure 7:
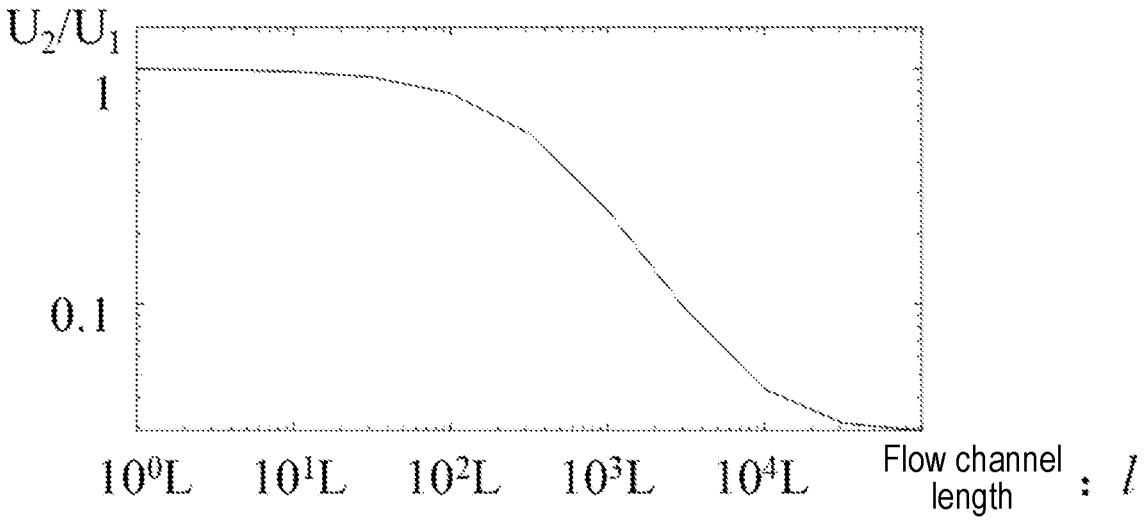
FIG. 7 is a potential diagram of non-triggered nozzle electrodes of different voltage-division units of the arrayed electrohydrodynamic printhead without extraction electrodes provided by the disclosure.

As shown in FIG. 1 to FIG. 7, the disclosure provides an arrayed electrohydrodynamic printhead without extraction electrodes including an ink cartridge 1, a flow channel plate 2, and a nozzle plate 3.

The flow channel plate 2 includes a drainage portion and a voltage division portion. The drainage portion connects the ink cartridge 1 and a branch flow channel of each nozzle 31 and is configured to introduce ink into the branch flow channel. The voltage division portion is configured to control a potential drop among different nozzles, and a geometric dimension may be designed to achieve better independent control.

The nozzle plate 3 is below the flow channel plate 2 and includes the nozzles 31, nozzle electrodes 32, and a hydrophobic layer. The nozzle plate 3 has a plurality of through holes and forms a hollow boss structure to form the nozzles 31, which facilitates the concentration of the electric field and easier to eject ink. Each of the nozzle electrodes 32 includes a patterned adhesive layer and a conductive layer, and the adhesive layer is configured to improve the stability of the connection between the conductive layer and the nozzle plate 3. The annular portions of the nozzle electrodes 32 are connected to the nozzles 31. Herein, the electrode voltage at each nozzle is individually adjustable, so that the on/off state of each nozzle is controlled. Finally, the hydrophobic layer protruding from a nozzle surface is made to prevent ink from spreading.

Further, voltage division units are composed of connection structures such as microfluidic channels among different nozzles in a nozzle. Its geometric design may be obtained from the resistance calculated by the principle of voltage division, and the resistance may be obtained by $$R = \rho \frac{l}{S},$$

where R is the resistance of the voltage division structure, ρ is the electrical resistivity of the ink, l is the length of the flow channel between the nozzles, and S is the cross-sectional area of each of the flow channels.

When the onset voltage of the injection is $U_0$, the voltage of the triggered nozzle electrode can be adjusted to $U_1$. Herein, the potential difference between the triggered nozzle and the non-triggered nozzle can be obtained as $$\Delta U = U_1 \times \frac{R}{R + R_0},$$

where $R_0$ is the grounding resistance of the non-triggered nozzle. When $U_1 - \Delta U < U_0$, the non-triggered nozzle may not be affected, so that the nozzle may be independently controlled.

The regulation of the potential difference ΔU is implemented by controlling the resistance R of the voltage division structure or adjusting the grounding resistance $R_0$ of the non-triggered nozzles. When independently controllable, the resistance R has the condition $$R > \frac{U_1 - U_0}{U_0} R_0.$$

The specific control method is to control the electrical resistivity ρ of the ink, the geometric parameter length l of the flow channels, and the cross-sectional area S. For a series of different inks, in order to allow the nozzles to be independently controlled, based on the minimum electrical resistivity ρmin of the ink, the flow channel structure of each nozzle may be designed to satisfy $$\rho_{min} \frac{l}{S} > \frac{U_1 - U_0}{U_0} R_0.$$

Conversely, for the nozzles that have been processed, the minimum electrical resistivity of the ink that meets the independently controllable requirements may be determined by $$\rho_{min} > \frac{U_1 - U_0}{U_0 l} S R_0.$$

Further during the printing process of the nozzle, for the non-triggered nozzle, the regulating voltage $U_2$ may be applied to regulate the electric field of the nozzle, so that the landing deviation of the triggered nozzle is smaller. The value range of the applied $U_2$ is $U_1 - \Delta U < U_2 < U_0$, which needs to be greater than the voltage division value of the triggered nozzle and smaller than a onset threshold to avoid spraying from the non-triggered nozzle.

Further the ink cartridge 1 is made of an insulating material and is prepared by injection molding, 3D printing, and other techniques. The ink cartridge 1 has an ink inlet 11 for filling ink and an ink outlet 12 for discharging excess ink. A lower portion of the ink cartridge has a flow channel layer inlet 13 and a flow channel layer outlet 14 to facilitate ink entering or flowing out of the flow channel plate 2.

Further, the flow channel plate may be obtained by processing a tree-like bifurcated micro-channel groove structure above an insulating substrate by using processes such as laser ablation, photolithography, and sandblasting. The tree-like bifurcated microfluidic channels are used to ensure that the flow rate of each orifice is uniform.

Further, a nozzle boss structure and an electrode structure are processed below the flow channel plate 2. The nozzle electrodes and the adhesion layer are made of chromium, the conductive layer is made of gold, and a patterned electrode is prepared by magnetron sputtering, evaporation, and other processes.

In a preferred embodiment of the disclosure, the ink cartridge 1 is made of an insulating material such as methyl methacrylate. The ink inlet 11 of the ink cartridge 1 is used for ink filling, and the ink outlet 12 is used for discharging excess ink. The lower portion of the ink cartridge 1 has the flow channel layer inlet 13 to facilitate the injection of ink into the flow channel plate. The flow channel layer outlet 14 is configured to facilitate the removal of air bubbles, and the installation holes 15 is configured to the installation and positioning of the ink cartridge.

The flow channel cavity of the flow channel plate 2 is obtained by ablating a tree-like bifurcated micro-channel groove structure on a ceramic sheet by laser with a width of approximately 100 μm and a depth of approximately 100 μm, and is divided into a flow channel inlet 21, a flow channel outlet 22, a drainage channel 23, and a microfluidic channel 24. For ethylene glycol ink, the surface tension is 46 mN/m, the relative permittivity is 41, the conductivity is 1 μS/cm (measured), and the length of the voltage division portion is 1 mm.

The nozzle boss structure of the nozzle plate is photolithographically prepared under the flow channel layer with SU-8 photoresist. The diameter of each nozzle is 50 μm, the protrusion height is 50 μm, and there are 8 nozzles with a pitch of 500 μm. Each of the nozzle electrodes 32 includes an adhesive layer and a conductive layer. The adhesive layer is chromium with a thickness of 100 nm. The conductive layer is gold with a thickness of 70 nm. It is prepared by a magnetron sputtering process, PI tape is used for punching holes as a mask, and the tape may be removed after magnetron sputtering to obtain an electrode pattern. The outer diameter of the ring portion of the electrode is 200 μm, and the width of the lead wire is 50 μm. Herein, the electrode voltage at each nozzle is individually adjustable, so that the ignition state of each nozzle is controlled. Finally, an evaporated Teflon hydrophobic layer protruding from the nozzle surface is made to prevent ink from spreading. Next, the ink cartridge 1 and the flow channel plate 2 are bonded with epoxy resin, and the electrode pins are led out with conductive tape and are sealed with epoxy resin.

When using the printhead to print, first, the installation holes 15 on the ink cartridge 1 is aligned with threaded holes on an experimental platform. A printhead is fixed on the experimental platform by bolts, and a printhead fixture is adjusted to keep the protruding structure of the nozzles parallel to a substrate. The fixture is used to make the bottom of printhead parallel to the substrate. A plastic hose is used to connect an ink supply system to an ink inlet. The ink supply system injects filtered and debubbled ink into a printhead through a flow pump, fills internal cavities such as the ink cartridge, flow channel cavity, and nozzles, and discharges the existing gas from an ink outlet and nozzles. After ink filling is completed, lead-out conductive tape is connected to a high voltage generating module. The printhead is adjusted to an appropriate height, the movement of the substrate and triggering of a high-voltage electrical signal are controlled by an industrial computer, and the patterned printing is completed.

Herein, the onset voltage of each of the nozzles is 2,000 V. When the nozzle is in use, a voltage of 2200 V is applied to the ignition nozzle to start the injection. Herein, the division voltage of the non-triggered nozzle is approximately 100V, which is far below the onset threshold, so no injection occurs. The nozzle is achieved independently controllable printing. Further, if it is necessary to regulate the electric field of the nozzle, a regulating voltage may be applied to the non-triggered nozzle, and the voltage range is between 100V to 2,000 V, which is used to regulate the printing accuracy of the printhead while ensuring independent controllability.

A person having ordinary skill in the art should be able to easily understand that the above description is only preferred embodiments of the disclosure and is not intended to limit the disclosure. Any modifications, equivalent replacements, and modifications made without departing from the spirit and principles of the disclosure should fall within the protection scope of the disclosure.

What is claimed is:

1. An arrayed electrohydrodynamic printhead without extraction electrodes, comprising an ink cartridge, a flow channel plate, and a nozzle plate, wherein the flow channel plate is disposed at a bottom portion of the ink cartridge, and a flow channel cavity thereof comprises a plurality of microfluidic channels communicating with the ink cartridge, the nozzle plate is disposed at a bottom portion of the flow channel plate, the nozzle plate comprises a plurality of nozzles and nozzle electrodes assembled therewith, the plurality of nozzles are correspondingly disposed and communicating with the plurality of microfluidic channels, and ink flows from the ink cartridge through the flow channel cavity and is ejected from the nozzles, the microfluidic channels between different nozzles and the ink in the microfluidic channels form a plurality of voltage division units, the triggered nozzles, the voltage division units, and the non-triggered nozzles form a voltage division circuit when a voltage is applied to the nozzles, and by adjusting a resistance value of the voltage division units or a grounding resistance value of the non-triggered nozzles, a potential difference between the triggered nozzles and the non-triggered nozzles is changed, so that a difference between the applied voltage and the potential difference is less than a onset threshold voltage, and that the nozzles are independently controlled, wherein the adjustment of the resistance of the voltage division units is implemented by adjusting an electrical resistivity of the ink and/or a geometric dimension of the microfluidic channels.

2. The arrayed electrohydrodynamic printhead without extraction electrodes according to claim 1, wherein the flow channel cavity further comprises a flow channel inlet, a flow channel outlet, and a drainage channel, the flow channel inlet and the flow channel outlet are located at both ends of the flow channel cavity, the transition channel is disposed between the flow channel inlet and the plurality of microfluidic channels and between the flow channel outlet and the plurality of microfluidic channels and is configured to evenly guide the ink in the ink cartridge into the microfluidic channels or to guide the ink in the microfluidic channels into the ink cartridge.

3. The arrayed electrohydrodynamic printhead without extraction electrodes according to claim 2, wherein the plurality of microfluidic channels comprise a tree-like bifurcated structure distribution, a bifurcated structure distribution, and a strip-shaped structure distribution.

4. The arrayed electrohydrodynamic printhead without extraction electrodes according to claim 3, wherein the ink cartridge comprises a cartridge body and installation holes, slots, an ink inlet, an ink outlet, a flow channel layer inlet, and a flow channel layer outlet disposed in the cartridge body, the slots are located on both sides of the cartridge body, the installation holes are disposed on the slots, the ink inlet and the ink outlet are disposed on an upper end of the cartridge body, the flow channel layer inlet is disposed on a lower end of the cartridge body and communicates with the flow channel inlet, and the flow channel layer outlet is disposed on the lower end of the cartridge body and communicates with the flow channel outlet.

5. The arrayed electrohydrodynamic printhead without extraction electrodes according to claim 2, wherein the ink cartridge comprises a cartridge body and installation holes, slots, an ink inlet, an ink outlet, a flow channel layer inlet, and a flow channel layer outlet disposed in the cartridge body, the slots are located on both sides of the cartridge body, the installation holes are disposed on the slots, the ink inlet and the ink outlet are disposed on an upper end of the cartridge body, the flow channel layer inlet is disposed on a lower end of the cartridge body and communicates with the flow channel inlet, and the flow channel layer outlet is disposed on the lower end of the cartridge body and communicates with the flow channel outlet.

6. The arrayed electrohydrodynamic printhead without extraction electrodes according to claim 1, wherein each of the nozzles is made of an insulating material, and one end of each of the nozzles is a hollow boss structure, and the hollow boss structures correspond to through holes of the microfluidic channels one-to-one.

7. The arrayed electrohydrodynamic printhead without extraction electrodes according to claim 1, wherein the nozzle plate further comprises a hydrophobic layer, and the hydrophobic layer is disposed on an outer surface of the nozzles and the nozzle electrodes.

8. The arrayed electrohydrodynamic printhead without extraction electrodes according to claim 1, wherein the ink cartridge is made of an insulating material or a conductive material plus a layer of insulating material.

* * * * *